US005383279A

United States Patent [19]

Tami

[11] Patent Number: 5,383,279

[45] Date of Patent: Jan. 24, 1995

[54] SIGHT GUARD SIGHT

[76] Inventor: Mark G. Tami, R.D. #1 Box 178A, Brockport, Pa. 15823

[21] Appl. No.: 223,672

[22] Filed: Apr. 6, 1994

[51] Int. Cl.[6] ..... F41G 1/467

[52] U.S. Cl. ..... 33/265; 124/87

[58] Field of Search ..... 33/265, 252, 260, 259; 124/87

[56] References Cited

U.S. PATENT DOCUMENTS

| | | | |
|---|---|---|---|
| 937,244 | 10/1909 | Kennedy | 33/260 |
| 2,991,556 | 7/1961 | Wilchek | 33/265 |
| 3,212,190 | 10/1965 | Larson | 33/265 |
| 3,666,368 | 5/1972 | Sprandel | 33/265 |
| 3,811,195 | 5/1974 | Carella | 33/265 |
| 3,849,894 | 11/1974 | Brougham | 33/265 |
| 4,417,403 | 11/1983 | Strange | 124/87 |
| 4,543,728 | 10/1985 | Kowalski | 33/265 |
| 4,999,919 | 3/1991 | Sparkman | 33/265 |
| 5,165,178 | 11/1992 | Seely | 33/265 |
| 5,253,423 | 10/1993 | Sullivan, Jr. et al. | 33/265 |

*Primary Examiner*—Thomas B. Will

[57] ABSTRACT

A one pin sight guard bow sight comprised of an arrangement of cylindrical sleeves mounted to a horizontal u-shaped sight guard. Elevation adjustment takes place by tilting of a vertical sighting pin affixed to a rotatable sleeve within the arrangement. A reference line relative to yardage lines inscribed on the surface of the sleeves are used for accurately calibrating the sight.

17 Claims, 4 Drawing Sheets

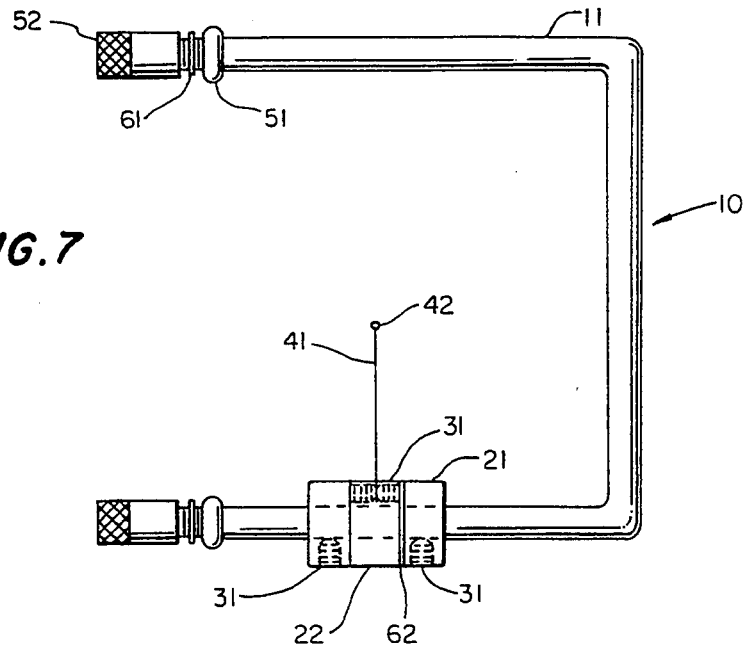
FIG. 7
FIG. 8
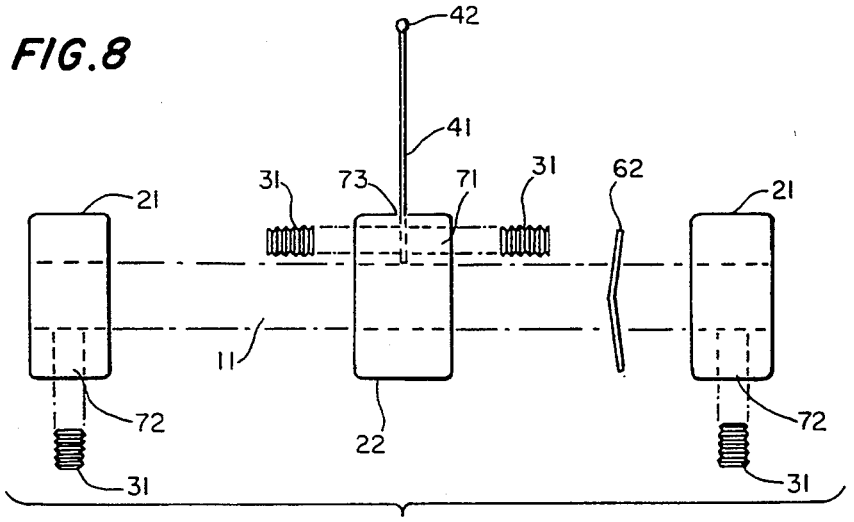
FIG. 9
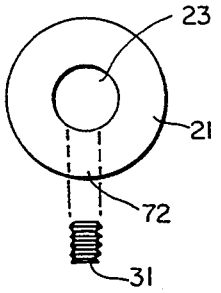
FIG. 10
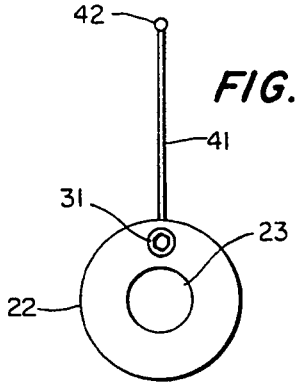
FIG. 11
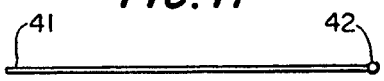

FIG. 12
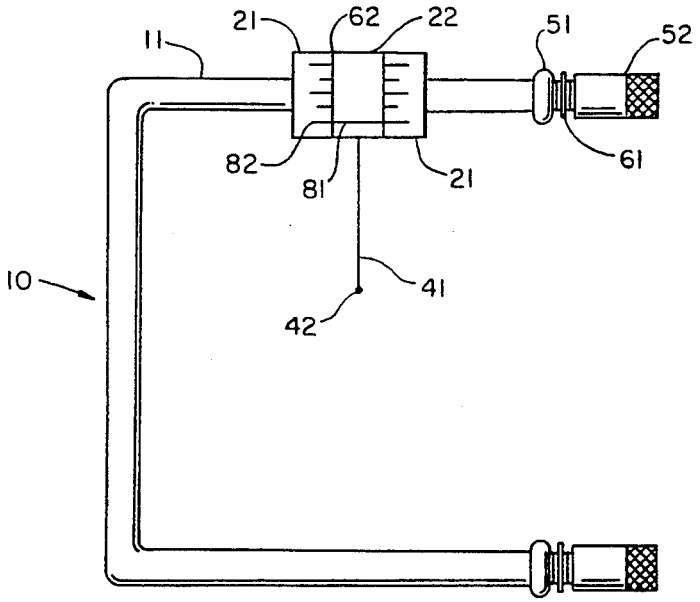
FIG. 13
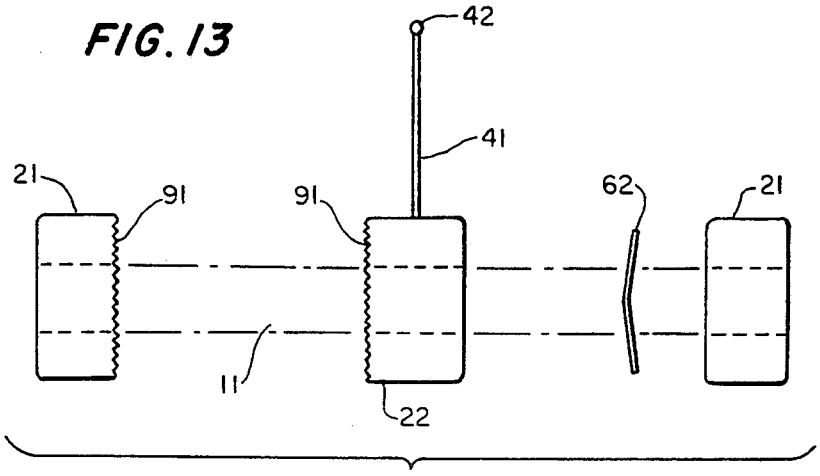
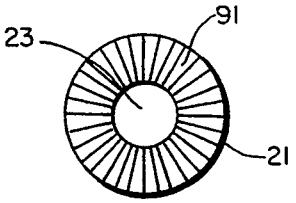
FIG. 14
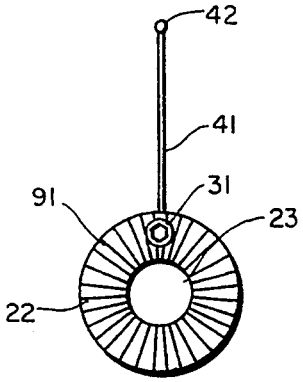
FIG. 15

SIGHT GUARD SIGHT

BACKGROUND OF THE INVENTION

1. Field of the Invention

The field of the invention relates to archery sights, and more particularly pertains to an adjustable one pin sight guard sight, as to modify most common conventional bow sights that accepts the standard u-shaped sight guard. When attached and set up properly to a bow sights side plate, the archer will be able to take all of the advantages of a more modern one pin bow sight without having to change their whole sight. It is in the best interest of the archer to have the flexibility of such sight for target shooting or hunting situations.

2. Description of the Prior Art

The most common bow sight used in the past, and still being used today is the multi-fixed pin sights. These sights employ a plurality of sighting pins fixed in a horizontal position on a slotted side plate attached to the bows riser. The archer sights the bow by using a peepsight attached to the string of the bow, he then sights through a small hole in the peepsight and aligns the fixed pin with the target. The pins are arranged in a vertical order as to yardage, using a lower pin forces the archer to raise his or her bow arm for achieving correct arrow trajectory over longer yardage. The advantage of this setup is, there no need for adjusting pins once setup. This may be ideal for the bowhunters, who's movements are limited during hunting situations.

Today, in the fast growing sport of 3D target archery, archers compete by shooting at realistic 3D foam animals set out in unknown distances in a natural setting. Archers using the multi-fixed pin sights or other sighting devices which employ a plurality of fixed sighting points are limited in accuracy, the fixed points or pins are usually set in five or ten yards increments, any target that falls between these set points is guess work when sighting the bow. For example, a target estimated at 32 yards, the archer must then hold the 30 yard pin high or the 35 yard pin low when sighting his bow. This has a resulting effect on the archers score.

More intricate and complex devices have been designed in the prior art in order to overcome various problems related to the multi-fixed pin sights, sights such as the Frydenlund U.S. Pat. No. 3,487,548, Watson U.S. Pat. No. 4,532,717, Greene U.S. Pat. No. 322,303, Martin U.S. Pat. No. 5,001,837, and Toxonics U.S. Pat. No. 4,020,560. These sights utilizes a single moveable sighting point in which the archer adjusts to the relationship of the estimated yardage of the target. The Sparkman U.S. Pat. No. 4,999,919 uses rubber bands on a sight guard to provide breaking lines to aid the archer in aligning the target, or "boxing" in. The problem with this setup, is the cluster of pins used with the rubberbands could confuse the archer on long distance shots. Drawbacks to the single moveable point sights, include, hand and finger movement during hunting situations, high costs and time consuming setups with the more complex models.

Various archery sights have been disclosed in the prior art, each of which addressing a particular problem and in some instances complicating the matter somewhat. There still exists the need for a simple inexpensive bow sight to utilized in both hunting and target archery.

SUMMARY OF THE INVENTION

In view of the forgoing disadvantages inherent in the known types of archery sights now present in the prior art, the present invention provides a novel bowsight wherein a u-shaped sight guard is used in combination with an arrangement of cylindrical sleeves to provide a simple one pin adjustable sight guard sight.

More specifically, a fine vertical sight pin is attached to a pivotable sleeve slideably mounted on the u-shaped sight guard, pivotable sleeve rotates between two fixed sleeves for adjusting of the sight. By tilting the vertical sight pin forward, the archer is forced to raise his bow arm to sight the pin on a distance target. By trial and error, the archer can calibrate the bow sight by inscribing yardage lines on the sleeves to correspond with the yardage of the arrow trajectory.

It is the objective of this invention to provide an adjustable one pin bow sight configured on a u-shaped sight guard which is compatible with most typical multi-fixed pin sights.

It is a further objective and advantage of the present invention to provide the archers the freedom of switching between hunting and target modes.

It is also a further objective of the present invention to provide a bow sight which is low in cost and simple in construction.

The advantages and objects of the sight guard sight will become easy to see from the following brief description of the drawings and understood when read in connection with the detailed description of the drawings.

BRIEF DESCRIPTION OF THE DRAWINGS

FIG. 7 is a front view of the sight opposite FIG. 2.

FIG. 8 is an enlarged detailed view of the sight sleeves assembly.

FIG. 9 is an enlarged side view of a end sleeve.

FIG. 10 is an enlarged side view of the medial sleeve.

FIG. 11 is an enlarged view of the sight pin.

FIG. 12 is a front view illustrating a different configuration of the present invention.

FIG. 13 is an enlarged view of the sight sleeve assembly showing a knurling configuration.

FIG. 14 is an enlarged side view of a sight sleeve illustrating the knurling configuration.

FIG. 15 is an enlarged side view of the middle sleeve illustrating the knurling configuration.

DESCRIPTION OF THE PREFERRED EMBODIMENT

Figure 1:
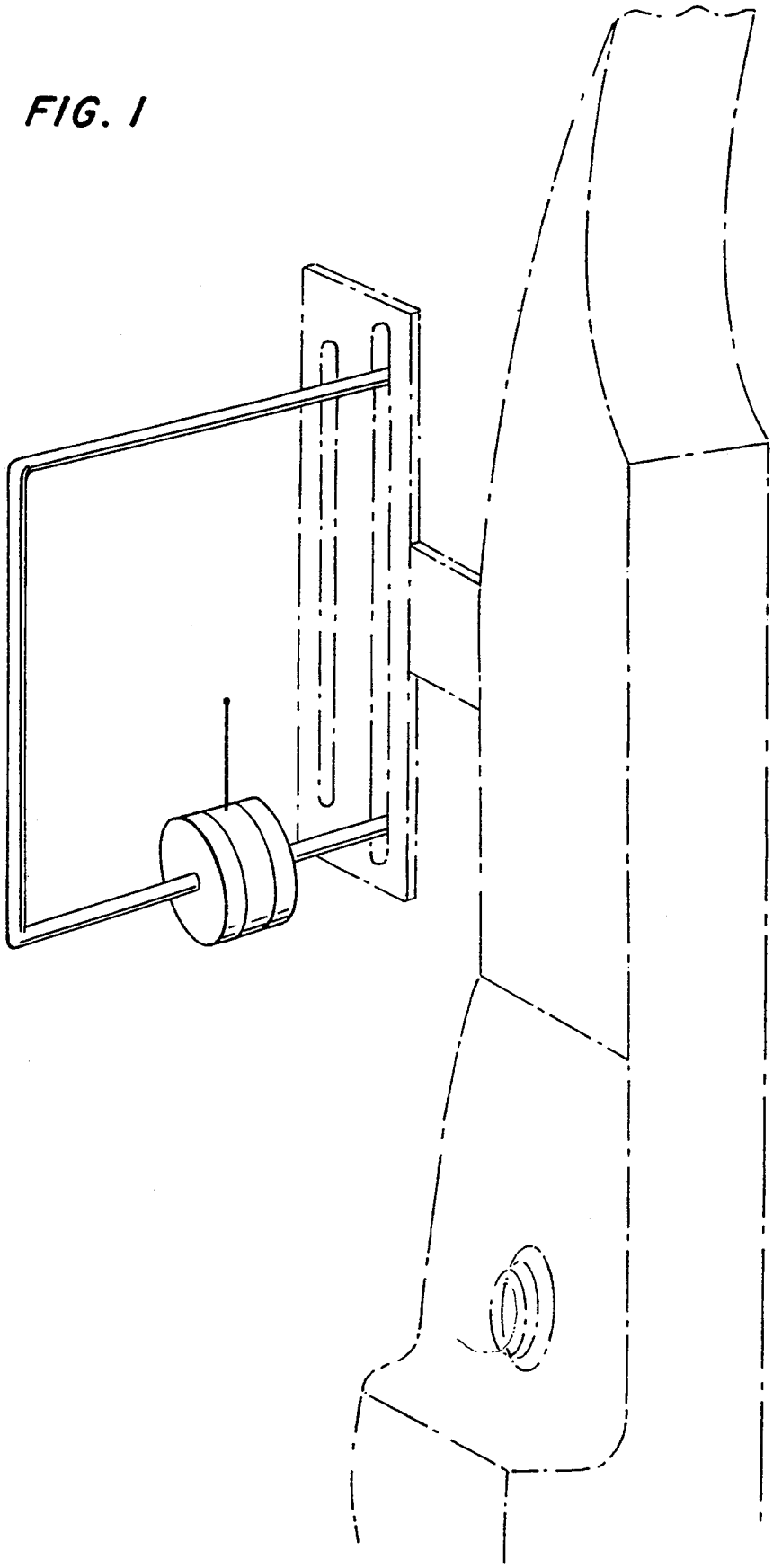
FIG. 1 is a perspective view of the sight guard sight attached to a side plate on a bow.
Figure 2:
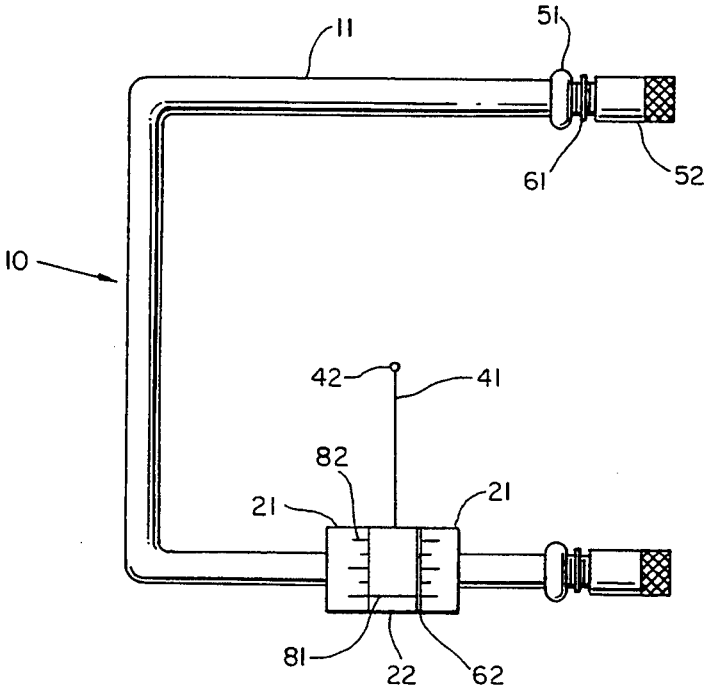
FIG. 2 is a archers view of the sight when held in the proper position.

With reference now to the drawings in which like numerals represent like elements throughout the several views, a presently preferred embodiment of the sight guard sight 10 is depicted in FIGS. 2, 7 and 12. Sight guard sight 10 comprises a horizontally u-shaped support rod 11 which may be conveniently mounted with hardware, 51, 61, 52, to a typical bow sight bracket attached to a bow's riser, as seen in FIG. 1. Mounted within the u-shaped support rod 11 in a predetermined position, is a side by side arrangement of three cylindrical sleeves, two fixed end sleeves 21, and a rotatable middle sleeve 22 comprising of a vertical sighting pin 41. The side view of the sleeves 21, 22 in FIGS. 9, 10, 14 and 15, illustrates the apparent circular shape, thus being concentric with it's center hole 23. Center hole 23 is bored slightly larger then support rod 11 for slideably mounting and adjusting the sleeves. Threaded holes 72 and socket head set screws 31 are used to fix the end sleeves 21 to the support rod 11 when the desired horizontal position is achieved. Shown in FIG. 8, middle sleeve 22 includes a detachable sight pin 41, vertically mounted in hole 73. Two socket head set screws 31 screwed inward from opposing sides into the hole 71 are used to secure the sight pin 41. The sighting pin 41 enlarged in FIG. 11 is a uniform in length and retaining a diameter of slightly less than hole 73 diameter for an adaptable fit. The upper end of the sighting pin 41 is illuminated with paint 42.

A further embodiment of the invention is shown in FIGS. 13, 14, 15, wherein the side face of the middle sleeve 22, and the side face of a end sleeve 21, comprise detents 91. The detents 91, as portrayed in FIG. 13 are formed by a knurling process. In FIG. 14 and FIG. 15 detents 91 are shown equally divided about it's circular face. The additional feature would allow the middle sleeve 22 to pivotally rotate in a clicking fashion as the detents 91 of said middle sleeve 22, engage and disengage with detents 91 of end sleeve 21.

Figure 3:
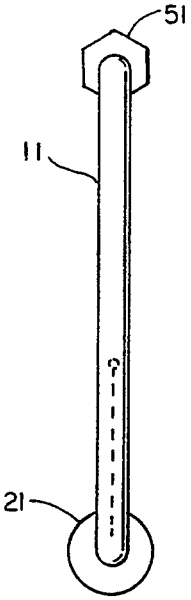
FIG. 3 is a side view of the sight.
Figure 4:
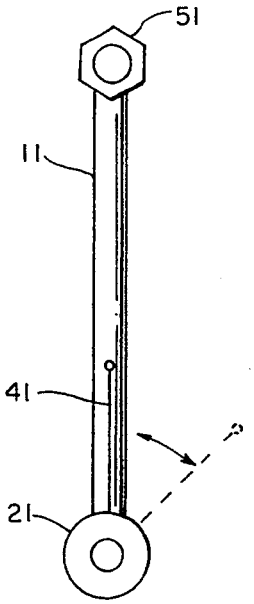
FIG. 4 is a side view of the sight opposite FIG. 3.
Figure 5:
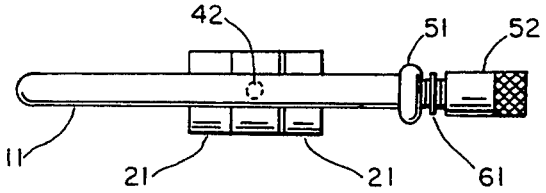
FIG. 5 is a top view of the sight.
Figure 6:
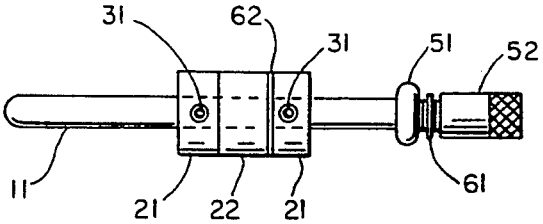
FIG. 6 is a bottom view of the sight.

In use the archer may elect to mount the sleeves to either the upper horizontal extension of support rod 11 as portrayed in FIG. 12 or to the preferred lower horizontal extension of the support rod 11 as portrayed in FIGS. 2 and 7, upon mounting the trio of sleeves to a determined horizontally position on the support rod, the archer will therein proceed to inscribe the yardage lines 82 on the outer circular surface of the end sleeves 21 as illustrated in FIGS. 2 and 12 as to correspond with the yardage of a predetermined target when sighting in a bow in the usual manner. Reference line 81 inscribed on the outside circular surface of middle sleeve 22 illustrated in FIGS. 2 and 12 is used to calibrate the sight when adjusting the pivotable middle sleeve in relationship to the trajectory of the arrow and the distance of the target corresponding to the yardage lines 82. The conical spring washer 62 is compressed between the sleeves as to provide frictional pressure on the pivotable middle sleeve as to maintain a determined position. FIGS. 3 and 4 illustrates the novel feature of the invention as the vertical sight pin is shown vertically erect and adjusted pivotally forward.

While the invention has been described using specific terms, such description is for illustrative purposes only, and it is to be understood that changes and variations may be made without departing from the spirit or scope of the following claims.

What is claimed is:

1. An archery bow sight adapted for mounting on a supporting means attached to a bracket affixed to an archers bow wherein the bow sight comprises;

an arrangement of cylindrical sleeves disposed on said support means wherein one of said sleeves includes a means of supporting and locking a sighting pin vertically, said sleeve with said supported sighting pin being pivotable in the relationship to the vertical plane of the bow string and therewith corresponding to horizontal elevation of a target and at least one end sleeve;

a means for fixing said arrangement of sleeves in a predetermined horizontally position on the supporting means so as to locate said sleeve with said supported sighting pin in a desired position;

a resilient means mounted between said pivotable sleeve and one other sleeve of said arrangement of sleeves so as to set said pivotable sleeve with said vertical sighting pin in a selective position relative to a desired trajectory of an arrow.

2. The sight as claimed in 1, wherein, said means for fixing the arrangement of sleeves comprises; a small threaded hole in each of the end sleeves of said arrangement tapped from the outside diameter portion of each end sleeve through to a center bore in each end sleeve, wherein a small set screw is used to fix each end sleeve to the support means.

3. The sight as claimed in 2, wherein, said means for supporting and locking a sighting pin vertically to the pivotable sleeve comprises; a small threaded hole beginning on an outer flat side face and traveling parallel with a center bore in said pivotable sleeve to the opposite outer flat side face, a relatively small hole relative to said threaded hole, wherein, commencing on the centered outer diameter portion of said pivotable sleeve and proceeding parallel with said outer flat side face wherein bisecting at a right angle to said threaded hole and proceeding through to the center bore, wherein, a sighting pin can be inserted vertically into said small hole, and locked in place by two socket head set screws abutting one another in said threaded hole.

4. The sight as claimed in 3, wherein, said resilient means comprises: a thin conical spring washer, having an inside center hole diameter no smaller than said sleeves center bore.

5. The sight as claimed in 4, wherein reference lines are inscribed on the outer surface of the sleeves to provide calibration means for adjusting the sight in relationship to the trajectory of the arrow.

6. The sight as claimed in 5, wherein said support means is a one piece u-shaped sight guard, comprising of a vertical section with two 90 degree bends forming upper and lower extensions, wherein said extensions are horizontally mounted to said bracket attached to the bow.

7. The sight as claimed in 6, wherein said archery sight is mounted to the lower extension of said sight guard.

8. The sight as claimed in 6, wherein said archery sight is mounted to the upper extensions of said sight guard.

9. The sight as claimed in 5, wherein said pivotable sleeve and at least one of the adjacent sleeves mounted to said support means are faced knurled on their outer flat side faces providing a detent means for retaining said pivotable sleeve in a selective position when rotatably adjusting the pivotable sleeve supporting said vertical sighting pin forward and backwards in respects to the corresponding inscribed reference lines.

10. An archery bow sight and sight guard assembly adapted for mounting to a bracket attached to a bow riser, wherein the bow sight and sight guard assembly comprises;

a one piece u-shaped sight guard, comprised of a vertical section with two 90 degree bends forming upper and lower horizontal extensions, wherein said extensions are perpendicular to said bracket affixed on the bow's riser, an arrangement of three cylindrical sleeves mounted on one of said extensions wherein the middle sleeve of the trio arrangement includes a means of supporting and locking a sighting pin vertically, said middle sleeve with said supported sighting pin also being pivotable in the relationship to the vertical plane of the bow string and therewith corresponding to the horizontal elevation of a target, a means for fixing the end sleeves of said trio arrangement in a predetermined position on said one of said extensions, and a means for calibrating the pivotal position of the middle sleeve and therefor the position of the sighting pin in relationship to a desired trajectory of an arrow over a given distance.

11. The sight guard sight as claimed in 10, wherein, said means for fixing the end sleeves of said trio arrangement comprises; a small threaded hole in each of the said end sleeves tapped from the outside diameter portion of each said sleeve through to a center bore in each said end sleeve, wherein a small set screw is used to fix each said end sleeve to said u-shaped sight guard.

12. The sight guard sight as claimed in 11, wherein, said means for supporting and locking a sighting pin vertically to the said pivotable middle sleeve comprises; a small threaded hole beginning on an outer flat side face and traveling parallel with a center bore in said middle sleeve to the opposite outer flat side face, a relatively small hole relative to said threaded hole, wherein, commencing on the centered outer diameter portion of said pivotable sleeve and proceeding parallel with said outer flat side face wherein bisecting at a right angle to said threaded hole and proceeding through to the center bore, wherein, a sighting pin can be inserted vertically into said small hole, and locked in place by two socket head set screws abutting one another in said threaded hole.

13. The sight guard sight as claimed in 12, wherein a thin conical spring washer, having an inside center hole diameter no smaller than said sleeves center bore, wherein said washer is mounted between two of said sleeves on said one of said extensions so as to provide a resilient means when rotating said middle sleeve.

14. The sight guard sight as claimed in 13, wherein said means for calibrating comprises; a series of incremental reference lines are inscribed on the outer surface of the sleeves corresponding to trajectory of the arrow in relationship to the distance of the target.

15. The sight guard sight as claimed in 14, wherein said trio arrangement of cylindrical sleeves are mounted to said upper horizontal extension of the said u-shaped sight guard.

16. The sight guard sight as claimed in 14, wherein said trio arrangement of cylindrical sleeves are mounted to said lower horizontal extension of said u-shaped sight guard.

17. The sight guard sight as claimed in 14, wherein said pivotable middle sleeve and at least one of the adjacent end sleeves mounted to said one of said extensions are faced knurled on the outer flat circular side face therein providing a detent means for retaining said pivotable middle sleeve in a selectively position when rotatably adjusting the pivotable middle sleeve supporting said vertical sighting pin forward and backwards in respects to the corresponding inscribed reference lines.

* * * * *